United States Patent [19]

Davenport et al.

[11] Patent Number: 4,524,962

[45] Date of Patent: Jun. 25, 1985

[54] PRE-FOLD, WEB SCORING APPARATUS FOR SIGNATURE FOLDING MACHINES

[75] Inventors: Harold D. Davenport, La Mirada; Anthony J. DeVito, Huntington Beach, both of Calif.

[73] Assignee: Penn Lithographics, Inc., Cerritos, Calif.

[21] Appl. No.: 648,379

[22] Filed: Sep. 7, 1984

[51] Int. Cl.[3] ..... B41F 13/56

[52] U.S. Cl. ..... 270/21.1; 493/397; 493/399; 493/404; 493/355

[58] Field of Search ..... 270/20.1, 21.1, 32, 270/54; 493/396-399, 405, 355; 100/169, 176

[56] References Cited

U.S. PATENT DOCUMENTS

| | | | |
|---|---|---|---|
| 1,196,912 | 9/1916 | Weck | 493/396 |
| 1,525,238 | 2/1925 | Hurd | 493/355 |
| 1,839,491 | 1/1932 | Novick | 493/404 |
| 3,198,092 | 8/1965 | Koran | 493/397 |
| 3,917,254 | 11/1975 | Watrous | 493/399 |
| 3,949,654 | 4/1976 | Stehlin | 493/396 |
| 4,014,535 | 3/1977 | Kleid et al. | 270/21.1 |
| 4,046,366 | 9/1977 | McCain et al. | 270/21.1 |
| 4,416,652 | 11/1983 | Fischer | 493/399 |

*Primary Examiner*—E. H. Eickholt

*Attorney, Agent, or Firm*—Fowler, Lambert & Hackler

[57] ABSTRACT

Prefold, web scoring apparatus for signature folding machines or the like comprises mating first and second web scoring rollers, each scoring roller having alternating scoring blade and resilient roller portions. The scoring rollers are mounted, preferably on existing, rotatably driven nip roll shafts, upstream of a first web folding stage in which the web is cut into sheets and the sheets are transversely folded, the folded sheets being fed therefrom to a second web folding stage for folding at right angles to the first stage fold. Arc lengths of each of the scoring roller blade and resilient roller portions is equal in length to the second stage fold line. The scoring rollers, between which the web is advanced, are positioned and oriented on their mounting shafts so as to score the web in alternating directions corresponding to the direction of folding of each paper layer in the second folding stage. Existing nip rollers and drive gears are modified or replaced as required so that the nip rollers are the same diameter as the scoring rollers and so that proper rolling contact between the pairs of nip rollers and of the scoring rollers is enabled. A corresponding method of web scoring is provided.

31 Claims, 15 Drawing Figures

PRE-FOLD, WEB SCORING APPARATUS FOR SIGNATURE FOLDING MACHINES

BACKGROUND OF THE INVENTION

1. Field of the Invention

The present invention relates generally to the field of printing press apparatus and more particularly to paper cutting and folding apparatus directly associated with continuous web printing presses.

2. Discussion of the Prior Art

Expensive, high speed printing presses are commonly used by commercial printing companies. Many such printing presses are fed from large rolls of paper and print on a continuous strip or web of paper, being thereby generally known in the industry as web presses. Full color web presses having several, serially arranged printing rollers for printing different colors and having output rates of about 40,000 printed articles per hour may, for example, cost between two and three million dollars each.

A web press typically requires use of an automated web cutting and folding machine which is connected to receive the printed web from the web press at web printing velocity. The cutting and folding machine automatically cuts the high speed web into sheets and folds the sheets one or more times into folded articles referred to in the printing industry as "signatures". These signatures may be sold as produced or may be delivered to other automated equipment which stitch or bind the signatures, often with other printed signatures, into booklets, magazines, books or the like. Because of their necessary complicated mechanical construction and electronic controls, such folders, known as signature folders, are very expensive and typically cost about 20 to 25 percent as much as their associated web presses.

Given the high cost of web presses and associated signature folders, it can be appreciated that the presses and folders must be capable of operating for extended periods of time at very high speeds in order to be cost effective and to produce finished signatures at industry competitive costs. Operation of the presses and folders at significantly below their maximum rated production speeds is, therefore, very inefficient from a cost standpoint.

Substantial problems which significantly limit folder and, hence, press speed are, however, commonly associated with high speed signature folder operation. These problems are principally associated with the second (quarter) fold and cause poor folding registration, thereby adversely affecting signature quality and causing additional problems in automated signature stitching and binding equipment in which many signatures are further processed before delivery to the customers.

To further explain the nature of problems encountered, it should be observed that many or most commonly used signature folders are constructed to perform two sequential paper folding operations. In a first folding stage the web, still traveling at printing velocity, is inserted along a fold line between first stage rollers which make the fold and cut the web. The cut and once-folded sheet is then usually folded again, in a second folding stage, perpendicularly to the first fold, the second fold being accomplished by a blade striking the already folded sheet along a second fold line and pushing the new fold between a pair of second stage rollers. Two stage folders constructed and operated in this manner are usually referred to as quarter folders since the resulting signatures are typically folded into quarters Provision may also be made at in-feed regions of some types of quarter folders to longitudinally fold the web by passing it over a partial-width roller having an attached "plow". The resultant two layer, longitudinally folded web is then treated as a single layer web, being subsequently folded crosswise in the first folding stage and then folded again in the second folding stage. The resulting signature is thereby actually folded into eight, instead of only four sections. Although preliminary, longitudinal folding of the web may occasionally be done, for purposes of discussion herein such folding will be largely ignored as not materially affecting operation of the above-mentioned "first" and "second" folding stages.

The incidence of folding problems associated with the first folding stage is ordinarily no greater than might reasonably be expected for high speed folder operation. This is because when the first fold is made across a transverse fold line, the web of printed substrate is still intact and taut. There is, therefore, minimal opportunity for paper slippage, even if the web has been preliminarily folded lengthwise and the so-called "first" fold is, in fact, of a double thickness of paper.

As above mentioned, concurrently with making the first, transverse fold, the web is cut so that the second, perpendicular fold is of a free, folded sheet having at least two overlaying layers of paper. It can be readily visualized that when the two (or four) layered, folded sheet from the first stage is struck by the second fold blade and is thereby pushed between the second fold rollers, substantial opportunity exists for free ends of the overlayed layers of paper to slip sideways relative to one another. When such paper layer slippage occurs, the second fold for one or more paper layers will not be square to the first, transverse fold. As a result, when the signature is bound or cut into pages, the pages will be uneven and printing or drawings continuing from one page to the next facing page will be misaligned. Signatures misfolded beyond permissible, small tolerances must be manually sorted from the correctly folded signatures and discarded.

Moreover, to accommodate certain following operations on the signatures, the second fold may intentionally be made slightly off center so as to cause one side of the fold to be a little wider than the other side, the projecting side edge of the wider side being used for automated signature feeding and/or positional control. If second stage misfolds cause the intentionally projecting edge to be too narrow or wide, or to be non-parallel with the other edge, automated handling and feeding of the signature is impaired and equipment stoppage or jamming may occur.

Second stage folding problems in signature folders have typically been found to increase very rapidly as maximum printing speed of the associated web press is approached. Therefore, to maintain signature folder problems within acceptable limits, press speed must often be reduced to a level which does not produce competitively priced signatures.

In order to overcome such problems associated with signature folders, some large, high speed web presses have associated therewith two separate signature folders, each of which can, therefore, be operated at half the press speed. Although signature production rate can thereby be substantially increased over that obtainable by use of only one signature folder, equipment costs are very greatly increased. Furthermore, often quite valuable floor space is required for the second signature folder.

Recognizing both the importance of using only one signature folder for each of the most commonly used web presses, and the substantial second stage folding problems associated with presently available signature folders, press and folder manufacturers have attempted to reduce the above-discussed second stage folding problems by providing for scoring of the web along the second fold line before the first fold is made. For such pre-fold scoring, the web is passed through a paper scoring apparatus installed in the signature folder upstream of the first folding stage. The scoring apparatus typically includes a circular scoring blade mounted to one side of the web and a resilient roller mounted to the other side of the web. As the web advances between the rotating scoring blade and roller, a longitudinal indentation or groove is pressed by the blade into the web along a line concident with the subsequent second fold line. A fine jet of water may be directed onto the web along the intended score line to locally soften the paper and reduce the possibility of cutting or tearing thereof by the scoring blade.

The intent of this pre-fold scoring of the web along the intended second fold line is that the second fold will follow along the scored line and any tendency for one layer of paper to slip relative to the other (or others) will be thereby eliminated or greatly reduced. As a result, increased operating speed of the signature folders and web presses should be possible. In fact, such has not proven to be the case. Contrary to general expectations of web press users, it had been the general experience that not only does the above-described, longitudinal pre-fold scoring of the web not significantly reduce second stage folding problems but such scoring usually increases second stage folding problems.

In this respect, it can be demonstrated by quarter folding a sheet of paper that such uniform, pre-fold web scoring scores only part of the sheet in the correct direction for second stage folding. The other part of the sheet is actually scored in the wrong direction for the second fold. As a result, instead of being nested closely together, the two paper layers tend to be spaced apart at the second fold line by back-to-back scoring. The second fold blade then impacts the uppermost paper layer along a peaked score line instead of along a score line valley. As the blade pushes the two layers together to make the fold, the score peak line tends to be pushed sidewardly from under the blade, thereby causing even greater second fold misalignment than would be expected to occur without the pre-fold scoring. In some quarter folders, at the second folding stage the score lines of the paper layers may be peak-to-peak resulting in a similar, greater tendency for paper side slipping during second stage folding. Therefore, to Applicants' knowledge, signature folders utilizing the above-described, pre-fold web scoring must still be operated at web speeds well below the maximum rated web speeds of the associated web presses in order not to exceed acceptable signature reject levels.

For these and other reasons, Applicants have invented a greatly improved pre-fold web scoring apparatus for use in signature folders and which scores the web in alternating directions corresponding to the second fold direction for each layer of the paper.

SUMMARY OF THE INVENTION

According to the present invention, pre-fold scoring apparatus is provided for a signature folding machine through which a printed paper is fed for folding into signatures, the folding machine having a first folding stage for folding paper across the direction of paper travel into the machine and having a second folding stage for folding folded paper from the first stage at right angles to the first stage fold. The pre-fold scoring apparatus of the present invention includes scoring means for prefold scoring of the paper in alternating directions along a longitudinal line corresponding to the second stage fold line. The scoring means include mating first and second scoring members each having separate scoring and resilient abutment portions configured for causing the lengths of the paper scoring in each alternating direction to be equal to the length of the second stage fold and for causing the paper to be scored in directions corresponding to the folding direction of each paper layer in the second folding stage. Means are provided for mounting the scoring means in the path of paper travel intermediate an associated printing press and the signature folding machine first folding stage so as to enable scoring of the paper before the paper enters the first folding stage.

Preferably the scoring means comprise first and second complementary-shaped scoring rollers, each of which has alternating, peripheral scoring blades and resilient roller portions having arc lengths equal to length of the second stage fold. The mounting means rotatably mount the first and second scoring rollers in the folding machine upstream of the first folding stage and in the path, of paper travel thereinto. Also, the mounting means mount the two scoring rollers in mutual, peripheral rolling contact so that the scoring blade portion of each contacts the resilient roller portion of the other as the scoring rollers are rotated. A portion of the paper passing between the scoring rollers is thereby scored in one direction and other portions of the paper are scored in the opposite direction in a manner that each layer of paper to be folded in the second folding stage is scored in the correct folding direction. Further included are means for rotating the scoring rollers so that the peripheral velocities thereof are equal to the linear velocity of paper being advanced therebetween and means for urging the two scoring rollers towards one another to create a sufficient scoring pressure on paper advancing therebetween to score the paper to a preselected depth.

Outer diameter of the blade portion of each of the scoring rollers is preferably between about 0.003" and about 0.008", and more preferably about 0.005", greater than the diameter of the resilient roller portion of the scoring rollers. Also preferably, each of the first and second scoring rollers have 180° blade portions and 180° resilient roller portions.

Included in the mounting means are a first scoring roller shaft onto which the first scoring roller is mounted and a second scoring roller shaft onto which the second scoring roller is mounted. The rotating means are configured for causing the first and second scoring roller shafts to rotate in opposite, paper advancing directions and at a rotational rate equal to the rotational rate of printing cylinders of an associated web printing press from which paper is fed into the folding machine. To enable the scoring rollers to be mounted on their respective shafts without necessity for removing the shafts, the scoring rollers are split in half across a diameter, the mounting means including means for clamping the two halves of each scoring roller together around its respective mounting shaft. As a result of such construction, lateral and rotational position of scoring rollers on their shafts can be quickly and easily adjusted, as may be necessary to align the scoring blades with the intended second stage fold line and to enable the scoring blades to properly score the web passing between the scoring rollers so that the scored lines correspond in position and direction with the second stage fold line for each layer of paper being folded. Non-rotatable mounting of the split scoring rollers to their respective shafts is enabled by constructing the scoring rollers so a central shaft mounting aperture of each is an interference fit relative to the outer diameter of its mounting shaft.

In a signature folding machine which, upstream of the first folding stage, includes a pair of first nip rollers mounted on a first, rotatably driven nip roller shaft and a pair of corresponding second nip rollers mounted on a corresponding second, rotatably driven nip roller shaft, the mounting means mount the first scoring roller on the first nip roller shaft intermediate the two first nip rollers and the second scoring roller on the second nip roller shaft intermediate the two second nip rollers.

To enable proper scoring for various different weights of paper, the scoring blade portions of the first and second scoring rollers are constructed so that each comprises a scoring blade having an arcuate scoring edge and means for detachably fixing the blade to the associated scoring roller so as to enable easy and rapid replacement of the scoring blades without dismounting the scoring rollers from their mounting shafts. The scoring blades are mounted about mid-width of the resilient roller portion of the same roller. Preferably, the arcuate edge of the scoring blades has a width of between about 0.020" and about 0.050" at the point of paper contact so as to provide a scored groove of about comparable width.

Preferably the resilient roller portions of the scoring rollers are constructed having the same outer diameter as the print cylinders used in an associated web press so that when the scoring rollers are rotated at the same rate as the print cylinders, peripheral velocities of both are matched.

Prefold web scoring apparatus may accordingly be provided for modifying existing signature folding machines which have first and second nip roller shafts mounted upstream of a first folding stage in which the web is cut and folded across the direction of web travel and having a second folding stage in which folded sheets from the first folding stage are folded along a longitudinal web direction, the apparatus comprising first and second web scoring rollers as above described for mounting onto the existing nip roller shafts. In the event that existing nip rollers mounted on the first and second nip roller shafts differ in diameter from the first and second scoring rollers, the apparatus includes properly sized pairs of first and/or second nip rollers as well as one or more properly sized drive gears for mounting on the nip roller shafts to enable the nip rollers and scoring rollers to be in proper engagement with the web passing therebetween.

Corresponding methods for pre-fold web scoring to assure proper second stage folding in signature folders are provided. These methods comprise the steps of forming first and second scoring rollers each having alternating scoring blade portions and resilient roller portions which are each equal in arc length to the length of paper fold made in the second folding stage, and mounting the first and second scoring rollers in the path of web travel into the first folding stage so as to cause the scoring of the web passing between the scoring rollers in alternating scoring directions corresponding to the paper layer folding directions in the second folding stage. The step of mounting the prescoring rollers may include mounting the first and second scoring rollers on respective, preexisting first and second nip roller shafts, the first scoring roller being then mounted between a pair of preexisting first nip rollers and the second scoring roller being then mounted between a pair of preexisting second nip rollers. If the preexisting first and second nip rollers are different in outer diameter from the respective first and second scoring rollers, the methods include the step of modifying the outer diameter of the first and second nip rollers to that of the resilient roller portions of the respective first and second scoring rollers and, as applicable, the step of modifying the size of at least one of said gears mounted on the nip roller shafts to correspond to the size of the modified first and second nip rollers.

The web scoring apparatus and corresponding web scoring methods of the present invention enable the pre-fold scoring of paper web in signature folder machines in a manner greatly enhancing the ability of an existing second folding stage in the folding machines to accurately make a final signature fold at high web velocities, thereby enabling the associated web presses to be operated at or near their full rated capacities. As a result, more efficient utilization of the web presses and signature folding machines is enabled and the cost of signature production is reduced and printing profits are correspondingly increased.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figure 1:
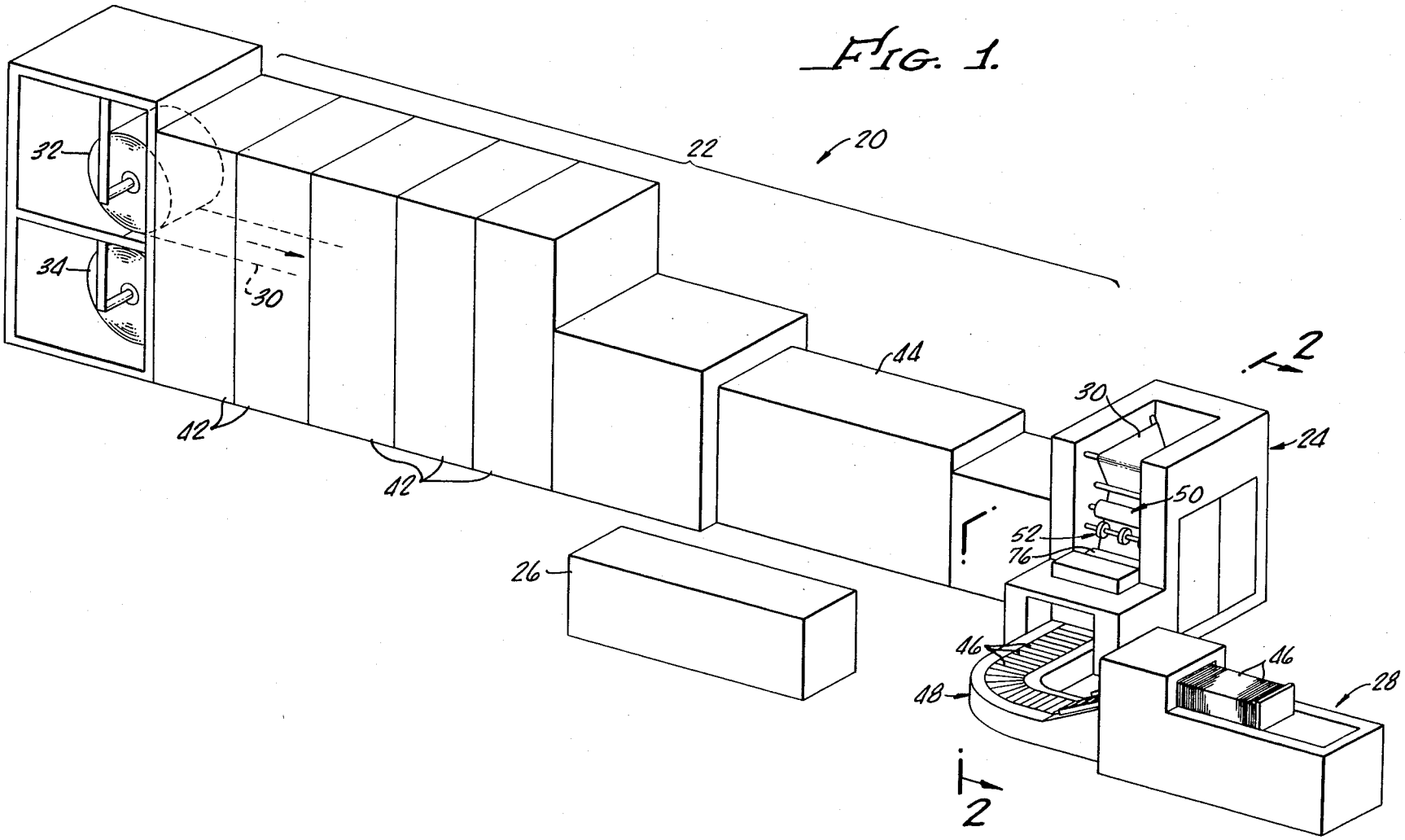
FIG. 1 is a pictorial perspective drawing showing an exemplary web printing press and signature folder in which the pre-fold scoring apparatus, according to the present invention, may be used to advantage.

The present invention, relating to scoring or grooving of paper in a signature folding machine prior to folding of the paper, can best be understood by a preliminary consideration of a typical, commercial-type printing station in which the invention may be used to advantage. To this end, FIG. 1 depicts an exemplary, high speed printing station 20. Generally comprising printing station 20 is a web (web-type) printing press 22, an automated signature folding machine 24, a control console 26 and an automated signature stacking machine 28. Web printing press 22 is fed a continuous strip or web 30 of blank paper from a large paper roll 32. A second, alternative paper roll 34 is shown mounted in readiness to feed press 22 after paper from roll 32 is consumed. Press 22 includes a plurality of serially arranged color print stages or stations 42 through which web 30 passes for full color printing. From the last-in-series one of the print stations 42, web 30 is fed into a dryer 44 in which ink deposited onto the web in the printing process is dried.

Web 30 is routed from print dryer 44 into signature folding machine 24 wherein the web is cut into sheets which are folded, generally twice, into folded articles or signatures 46. An associated conveyor 48 is provided for transporting signatures 46 from folding machine 24 into automatic stacking machine 28. The stacked signatures 46 are typically transferred (manually) from stacking machine 28 to other automated equipment (not shown) in which the signatures may, for example, be assembled into books, magazines or the like.

Coordinated operation of printing press 22, signature folding machine 24, conveyor 48 and stacking machine 28 is enabled by a system (not shown) of motors, gear trains, drive chains, etc., controlled generally at control console 26. Various mechanical, electronic and/or optical control apparatus (also not shown) are provided for assuring proper printing registration, sheet cutting and so forth.

Signature folding machine 24 is particularly relevant to the present invention. As more particularly described below, folding machine 24 includes various sections or stages in which web 30 is perforated, cut into sheets and the sheets folded as required to produce signatures 46. For illustrative purposes, with no limitation intended or implied thereby, signature folding machine 24 is shown in various of the Figures and is described herein as a "quarter-fold" type in which signatures 46 are folded into four quarters or sections, two folding operations being performed on sheets cut from web 30.

It should be observed, however, that quarter-fold signature folding machine 24 may have capability for folding entire web 30 lengthwise along the direction of web travel as, or just after, the web enters the folding machine. As a result, the below described, subsequent two folding operations are performed on a double layered web such that signatures 46, in fact, have eight, rather than four, sections. Such preliminary lengthwise folding of web 30 does not affect operation of the two subsequent, "quarter" folding operations except to the extent that the second quarter-fold is required to be made on four, rather than only two, paper layers and folding registation difficulties are accordingly increased. Insofar as the discussion herein is concerned, the preliminary lengthwise folding of web 30 will be ignored and it is to be clearly understood that the "first" folding operation and/or stage as discussed herein relates to the initial crosswise or lateral folding of web 30, whether or not the web has been longitudinally folded further upstream.

Figure 2:
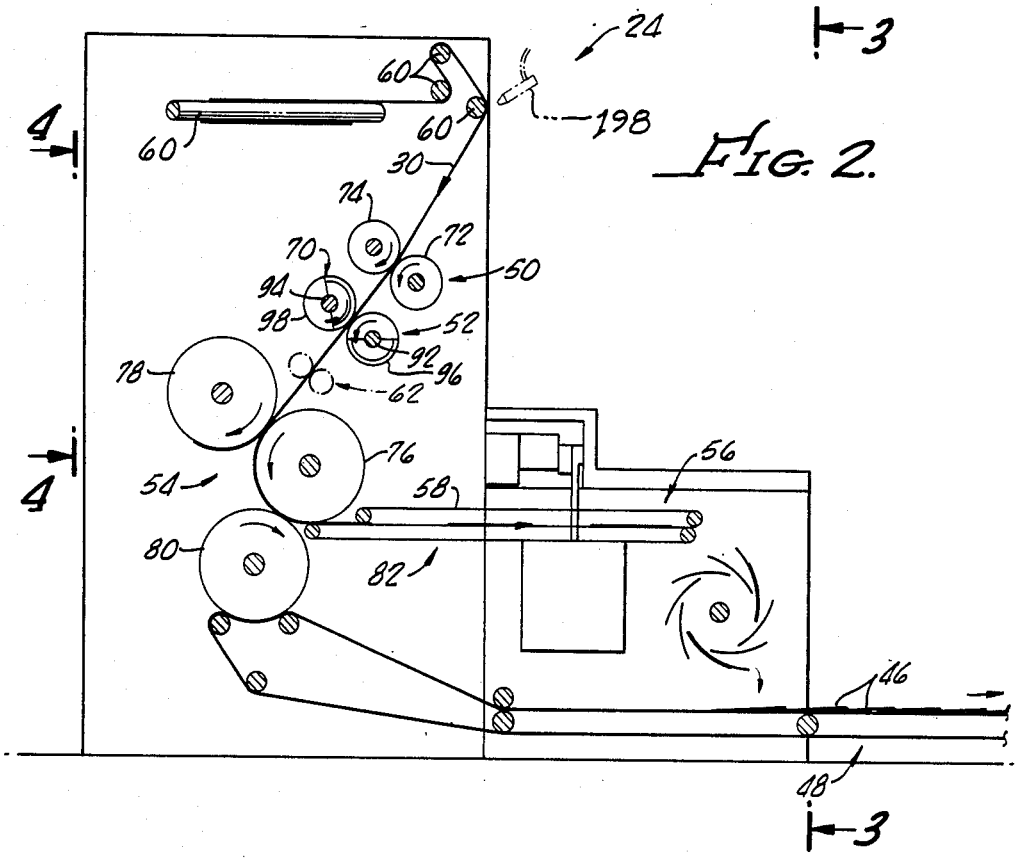
FIG. 2 is a cross-sectional diagrammatic drawing of the signature folder, taken along line 2—2 of FIG. 1, showing the paper web path through the signature folder and showing internal construction thereof.

As diagrammed in FIG. 2, a typical quarter-fold, signature folding machine 24 comprises a web perforating stage 50, a web guide (nip) roller stage 52, a first folding stage 54 and a second folding stage 56 through which web 30, or sheets 58 cut therefrom, pass through in sequence. Several additional guide rollers 60 are shown provided upstream of web perforating stage 50 for guiding web 30 from press 22 into operational portions of folding machine 24. One such roller 60 may, for example, be oriented so that the web path is caused to make a 90° lateral change in direction for more efficient folding machine arrangement relative to the press.

Figure 3:
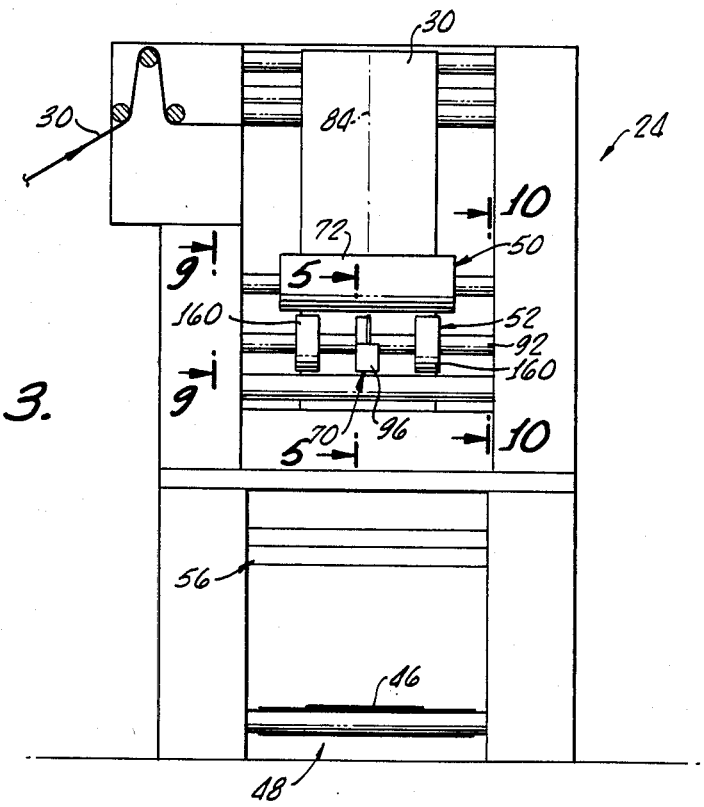
FIG. 3 is a transverse sectional drawing, taken along line 3—3 of FIG. 2 looking into the front of the signature folder and showing the pre-fold scoring apparatus of the present invention and upper portions of a first paper folding stage.

A preexisting, continuous direction, web scoring stage 62 is shown in phantom lines intermediate perforating stage 52 and first folding stage 54. Such preexisting scoring stage 60 is removed and replaced by Applicants' web scoring apparatus 70, which is shown in FIG. 3 as mounted in preexisting nip roller stage 52 in a manner described below.

In perforating stage 50, which comprises first and second, full width perforating rollers 72 and 74, web 30 may optionally be perforated at separated places along a transverse line, which becomes the first folding stage fold line, to enable, as the first folding operation is performed, escape of entrapped air which might otherwise cause folding problems. In first folding stage 54, as web 30 passes between first and second rollers 76 and 78, it is cut into sheets 58 typically between about 11 and about 54 inches long, the first stage fold of the cut sheets being performed between first roller 76 and a third roller 80. The transversely folded sheets 58 are serially discharged from first folding stage rollers 76 and 80 onto a conveyor 82 which transports the folded sheets to second folding stage 56.

In second folding stage 56, a second stage blade or paddle (not shown) pushes the folded sheets 58, one at a time, between a pair of second stage folding rollers (not shown), thereby causing the second folding of the sheets 58 along a fold line which is at 90° to the transverse fold made in first folding stage 54. As a result of the second fold being at right angles to the first, transverse fold the second fold is made along a longitudinal web line 84 (FIG. 3). The double folded sheets 58 are discharged from second folding stage 56, as signatures 46, onto conveyor 40 for transporting to signature stacking machine 28 (FIG. 1).

Figure 5:
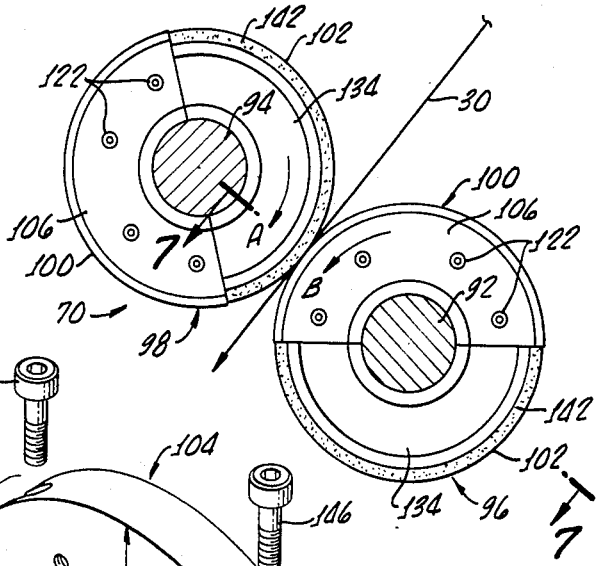
FIG. 5 is a cross-sectional view taken along line 5—5 of FIG. 3 showing the scoring rollers mounted on preexisting nip roller shafts.

Web scoring apparatus 70, according to the present invention, very importantly is configured for causing alternative direction scoring of web 30 along web line 84 before the web enters first folding stage 54. Although, for illustrative purposes, web scoring apparatus 70 is shown and described as being mounted onto preexisting, first and second nip roller shafts 92 and 94 (FIGS. 2 and 5), which comprise part of preexisting nip roller stage 52, such mounting is not essential to the invention and the invention is not limited thereto. However, when such nip roller shafts 92 and 94 are already, as shown, provided in signature folding machine 24, these shafts 92 and 94 may advantageously be used for the mounting of Applicants' scoring apparatus 70.

Figure 6:
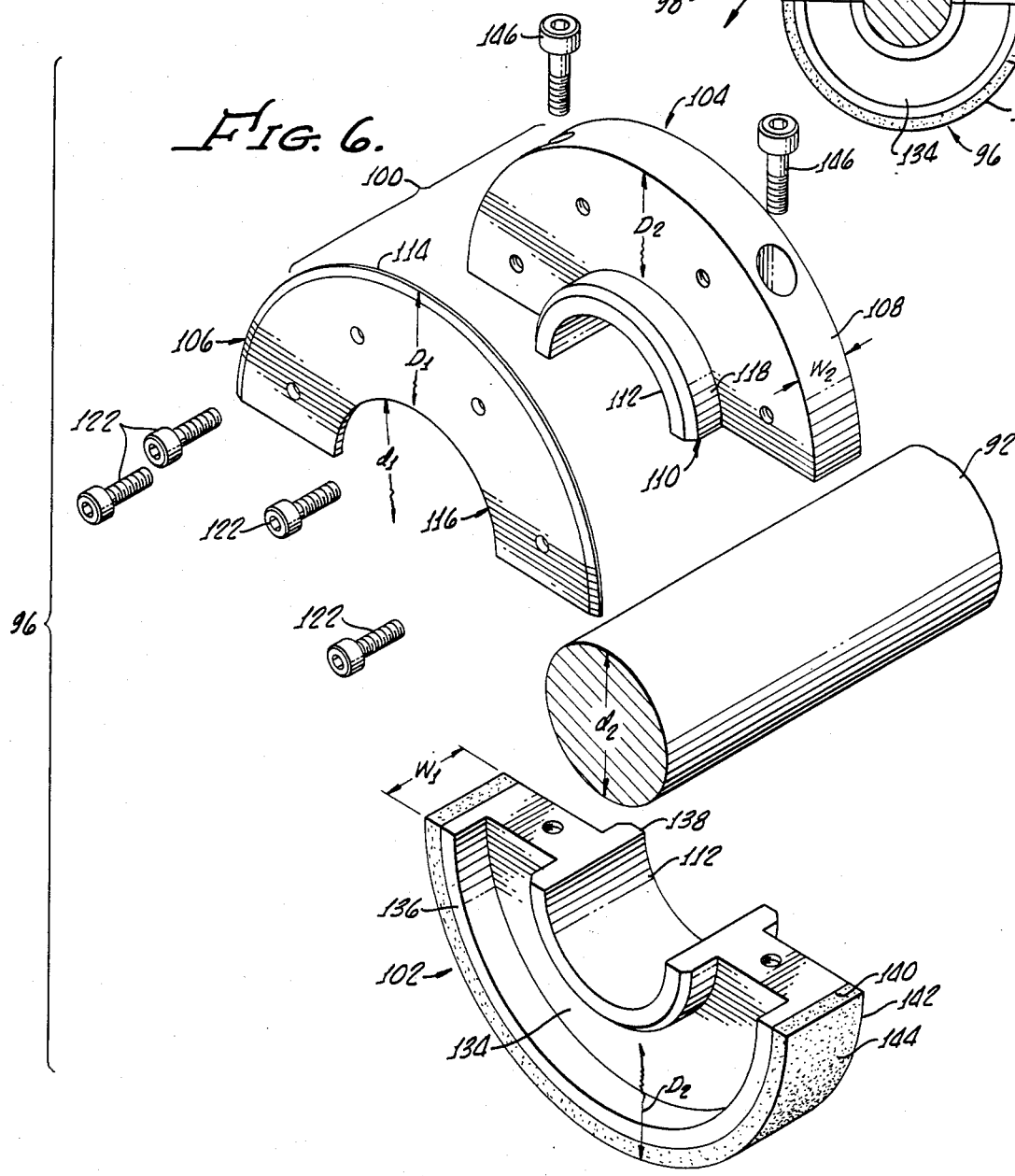
FIG. 6 is an exploded perspective drawing of the scoring rollers showing construction features thereof.

Comprising web scoring apparatus 70 are mating first and second, web scoring members or rollers 96 and 98, respectively. Preferably, scoring rollers 96 and 98 are constructed in an identical manner. Accordingly, only first scoring roller 96 will be described in detail. To enable easy and rapid mounting and removal of the scoring rollers 96 and 98, the scoring rollers are split in half across a diameter. As a result, first scoring roller 96 is, as shown in FIG. 6, formed of respective first and second semi-circular portions 100 and 102, first portion 100 being the web scoring portion and second portion 102 being a corresponding, resilient roller or blade abutment portion.

Comprising scoring portion 100 is a relatively thick and heavy, semicircular element 104 and a thin, semicircular scoring blade 106. Element 104 is formed having a semicircular, radial section 108 from which projects a semicircular flange 110 which defines half of a central mounting aperture 112. Scoring blade 106 is formed having a tapered, semicircular web scoring edge 114 around the outer periphery and a concave semicircular cutout 116 which enables the blade to fit closely over an outer surface 118 of element 104. The outer diameter, $D_1$, of blade 106 at edge 114 is slightly greater than the outer diameter, $D_2$, of an outer peripheral surface 120 of element section 108, preferably by between about 0.002 inches and about 0.008 inches and more preferably by about 0.005 inches.

Four bolts 122 detachably connect blade 106 to section 108. Bolts 122 enable easy attachment and removal of the blade, for such purposes as exchanging different blades which may be used with different paper thicknesses of web 30, without otherwise disassembling or removing apparatus 70 from folding machine 24.

Second roller portion 102 of scoring roller 96 is formed of a rigid, radial section 134 having a semicircular outer peripheral flange 136 and a semicircular inner flange 138 (similar to flange 110 of element 104), the inner flange defining the other half of mounting aperture 112.

Bonded to an outer surface 140 of outer flange 136 is a resilient strip 142 having a width equal to the width, $w_1$, of outer flange 136 and having a thickness of, for example, about ¼ inch. The diameter, $D_2$, of roller portion 102, to an outer surface 144 of resilient strip 142 is equal to the diameter, $D_2$, of element 104 of scoring blade portion 100. Consequently, the edge diameter, $D_1$, of blade 106 is greater by the amount described above than the diameter, $D_2$, of roller portion 102 to thereby enable paper scoring as described below. Peripheral width, $w_1$, of roller portion 102 is preferably about twice the width, $w_2$, of radial section 108 of blade portion 100 so that when blade and roller portions 100 and 102 are assembled together, by two bolts 146, to form scoring roller 96 (or 98), blade 106 is located at about mid-width of resilient strip 142.

To enable non-rotatable mounting of scoring roller 96 to shaft 92, and of scoring roller 98 to shaft 94, the inner diameter, $d_1$, of scoring roller aperture 112 is made slightly smaller than the corresponding outer diameter, $d_2$, of shafts 92 and 94 so as to provide an interference fit. Accordingly, when portions 100 and 102 of scoring roller 96 and 98 are fit around corresponding shafts 92 and 94 and connecting bolts 146 are tightened, the rollers are immovably connected to the shafts. In addition to enabling a non-slip fit between scoring rollers 96 and 98 and shafts 92 and 94, such split construction of the scoring rollers enables the rollers to be installed into their respective shafts without the necessity for removing the shafts from folding machine 24.

Figure 7:
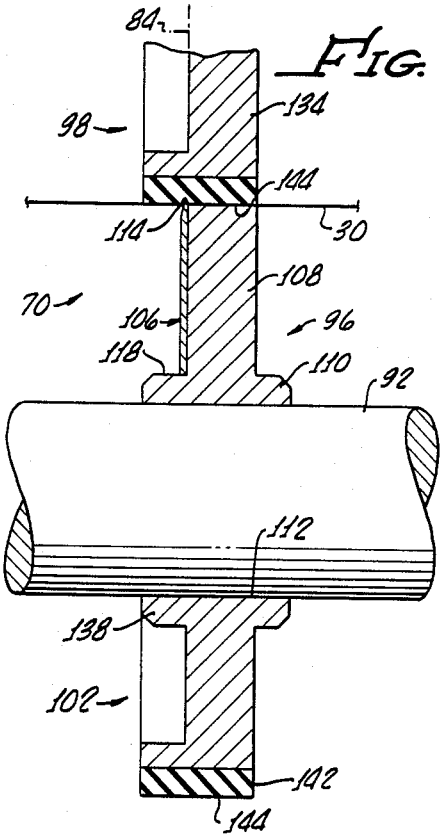
FIG. 7 is a cross-sectional drawing, taken along line 7—7 of FIG. 5 showing other features of the scoring rollers.

Scoring rollers 96 and 98 are mounted on respective shafts 102 and 104 so that blades 106 of each are in a common plane passing through and perpendicular to, second fold and scoring line 84 (FIG. 7). Moreover, scoring rollers 96 and 98 are constructed and are rotatably oriented upon mounting on shafts 102 and 104 so that when the shafts and scoring rollers are rotated in opposite, paper feeding directions (FIG. 5) the blade edge 114 of blade portions 100 of each of the rollers rolls along resilient roller strip 142 of the other scoring roller. Diameter, $D_2$, of the scoring rollers 96 and 98 and the separation between mounting shafts 92 and 94 are, of course, such that the scoring rollers are, during scoring operation, in peripheral rolling contact with one another.

Figure 8:
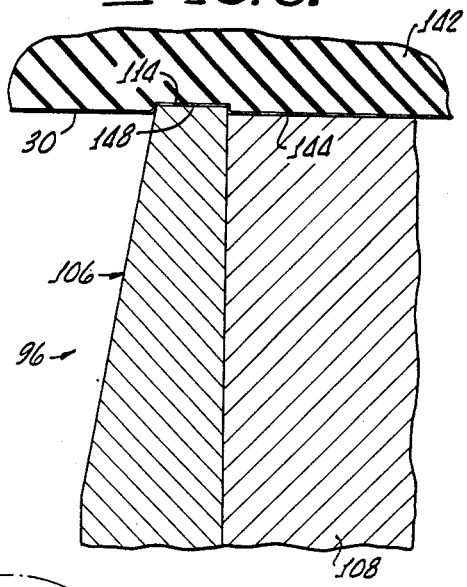
FIG. 8 is an oversize drawing showing scoring engagement of scoring blade portions of the one of the scoring rollers with the paper passing between such blade portion and resilient roller portions of the opposing scoring roller.

As a consequence of blade edge diameter, $D_1$, being slightly greater than resilient roller diameter, $D_2$, when the scoring rollers are in peripheral rolling contact with one another, blade edge 114 causes an indentation several thousandths deep into the abutting resilient roller strip 142 (FIGS. 7 and 8). Thus, when advanced between rotating rollers 96 and 98, web 30 is pushed along line 84, by blade edge 114 a slight distance into resilient strip 142, a grooved indentation or score 148 being thereby caused in the web along line 84.

It can be appreciated that as web 30 advances between rotating scoring rollers 96 and 98, the web is thereby alternately scored, along line 84, a particular distance in one direction by blade 106 of first scoring roller 96 and for a particular distance in the opposite direction. That is, looking at one side of web 30 after the web has advanced between scoring rollers 96 and 98, alternating lengths of indented and raised scorelines 148 are seen along line 84.

For web 30 to be scored by scoring rollers 96 and 98 correctly for subsequent sheet folding in second folding stage 56, the length of the score line 148, along line 84, in each direction should be equal to the length of the second stage fold. Also, for proper web scoring, the peripheral velocity of scoring rollers 96 and 98 should be the same as the linear velocity of web 30 as the web advances between the rollers; otherwise slippage will occur between the web and scoring rollers, misscoring will occur and tearing of the web is likely. These two conditions require that the arc length of blades 106 and resilient strips 142 be equal in length to the length of the second stage fold. Since blade edge diameter, $D_1$, is slightly greater than diameter, $D_2$, of resilient strips 142, to enable blade indentation of the strips, the arc length of blade edges 114 will in fact, be slightly greater than the second stage fold line. It is, however, to be understood that for purposes of describing and claiming the present invention, the arc length of the blade portions 106 are considered equal to the second stage fold line, as is practically the case.

Ordinarily, shafts 92 and 94 will be rotatably driven, through gears 150, 152, 154 and 156 (FIG. 9), at the same rotational velocity as the various print rollers (not shown) in printing press 22. This rotational rate of shafts 92 and 94 dictates, to attain matching roller peripheral and web advancing velocities, that the diameter ($D_2$) of both scoring rollers 96 and 98 be equal to the print roller diameter, which for a typical cut sheet length of 23 inches is about 7.321 inches.

Accordingly, for the exemplary folding machine 24 illustrated, scoring rollers 96 and 98 are each about 7.321 inches in diameter ($D_2$) and have 180° (semicircular) blade portions 100° and 180° resilient roller portions 102. Diameter of scoring roller mounting aperture 112 may be about 2-½ inches, being a few thousandths smaller than the outside diameter of shafts 92 and 94 at the roller attachment positions. Inner diameter, $d_1$, of blade 106 may be about 1-½ inches. The combined thickness of flange 136 and strip 142 is about 11/16 of an inch. Nominal thickness of blade 106 may be about 3/32 of an inch with width of blade edge 114 being between about 0.031 inches and about 0.062 inches. Other than blade 106 and resilient strip 142, scoring rollers 96 and 98 may be constructed of steel, the blades being constructed of tool steel or knife blade steel.

Figure 9:
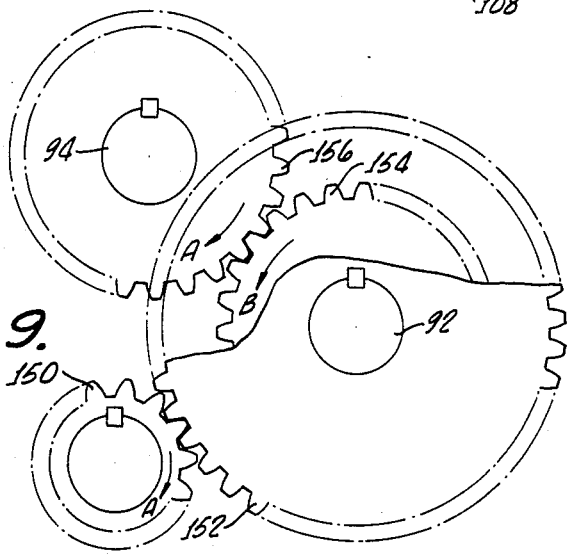
FIG. 9 is a view taken along line 9—9 of FIG. 3 showing gear train means for rotatably driving the shafts onto which the scoring rollers are mounted.

As shown in FIG. 9, preexisting nip roller shafts 92 and 94, on which scoring rollers 96 and 98 are preferably mounted, have fixed thereto at one end intermeshing gears 154 and 156 respectively. Also fixed to first shaft 92 is gear 152 which is driven by gear 150 which is in turn, driven by other portions of a drive train (not shown). Driving of gear 150 in the clockwise direction shown (direction of Arrow "A" causes shaft 92, with first scoring roller 96 mounted thereto, to be rotated in the clockwise direction (direction of Arrow "B"). Such counterclockwise rotation of shaft 92 causes, through gears 154 and 156, second shaft 94, and second scoring roller 98 mounted thereon, to rotate in a clockwise direction (direction of Arrow "A").

Figure 4:
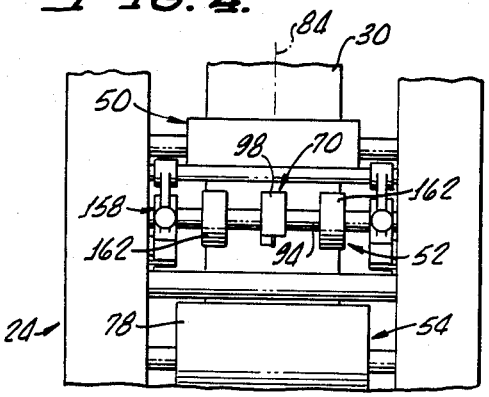
FIG. 4 is a drawing taken along line 4—4 of FIG. 2 looking into the back of the signature folding machine and showing location of the scoring apparatus and upper regions of the first paper folding stage.

In typical folding machines 24, of the type illustrated and described herein, means 158 are provided for mounting nip roller shafts 92 and 94 in a manner enabling the shafts to be selectively moved apart and together. When shafts 92 and 94 are moved apart by means 158, scoring rollers 96 and 98 are out of contact with one another and can, therefore, be readily installed onto, removed from, or slid along, their respective shafts. Pairs of preexisting first and second nip rollers 160 and 162 (FIGS. 3 and 4), can similarly be installed onto, removed from or positioned along respective shafts 92 and 94, the nip rollers mounted on both sides of scoring rollers 96 and 98, being also formed in half sections which are bolted together around the nip roller shafts.

Comprising preexisting means 158 is a shaft 164, which is parallel to nip roller shafts 92 and 94. On each end of shaft 164 is pivotally mounted a bracket 166, first nip roller shaft 92 being pivotally mounted at each end in such brackets. As a result, first nip roller shaft 92 can be pivoted around shaft 164 in the directions of Arrows C-C′ to move shaft 92 away from or towards second nip roller shaft 94 and therefore move scoring rollers 96 and 98, as well as nip rollers 160 and 162 out of and into mutual engagement. Two pneumatic actuating cylinders 168 are provided, one each being mounted between each shaft mounting bracket 166 and a bracket 170 fixed to a side wall 172 of folding machine 24. Actuation of cylinders 168 therefore, moves nip roller shaft in directions C or C′ depending upon the cylinder actuation direction. Stops 182 and 184 are mounted on wall 172 so as to limit travel of shaft 92 by limiting movement of an ear 186 projecting from bracket 166 between the stops.

Applicants' have determined that in some commercially available signature folders, first and second nip rollers (corresponding to nip rollers 160 and 162) are slightly larger in outside diameter than print cylinders in associated web presses. Since nip rollers 160 and 162 are rotated at the same rotational rate as the print cylinders, there necessarily is some tendency for the nip rollers to slip relative to web 30 advancing therebetween. When scoring rollers 96 and 98 are mounted on the same shafts 92 and 94 on which such oversize nip rollers 160 and 162 are mounted, scoring registration problems have been found to occur. Applicants have determined that such problems can be overcome by providing nip rollers 160 and 162 having the same outer diameter ($D_2$) of scoring rollers 96 and 98. With such outer diameter matching between nip rollers 160 and 162 and scoring rollers 96 and 98, tendency of the nip rollers to advance web 30 at a localized velocity greater (or less as the case might be for undersize nip rollers) than the peripheral velocity of the scoring rollers is eliminated and web scoring by the scoring rollers is found to be correctly registered. Therefore, according to the present invention, preexisting nip rollers 160 and 162 may be replaced with correctly sized nip rollers or oversized preexisting nip rollers may be resized, as by turning down the outer diameter thereof.

In FIG. 9 it is shown that nip roller shafts 92 and 94 are interconnected through intermeshing gears 154 and 156. If oversize (or undersize) nip rollers 160 and 162 require rework, or replacement rollers are provided to match outer diameter, $D_2$, of scoring rollers 96 and 98, it is likewise necessary to rework or replace one or both nip roller shaft gears 154 and 156. This is necessary so that nip rollers 160 and 162 and scoring rollers 96 and 98 can be moved, by means 158, into correct rolling contact with corresponding other ones of the nip and scoring rollers. If nip rollers 160 and/or 162 are required to be of reduced outer diameter, one or both gears 154 and 156 may be replaced with a properly sized gear or may be reworked to reduce the root and crest diameters thereof an appropriate amount. If undersized nip rollers 160 and 162 have to be replaced, replacement of one or both gears 154 and 156 will ordinarily also be required. It is, therefore, further within the scope of the present invention to provide properly sized gears 154 and/or 156.

Accordingly, a web scoring kit may be provided for retrofitting signature folding machines 24, the kit comprising scoring rollers 96 and 98 as well as properly sized nip rollers 160 and 162 and properly sized gears 154 and/or 156.

Figure 10:
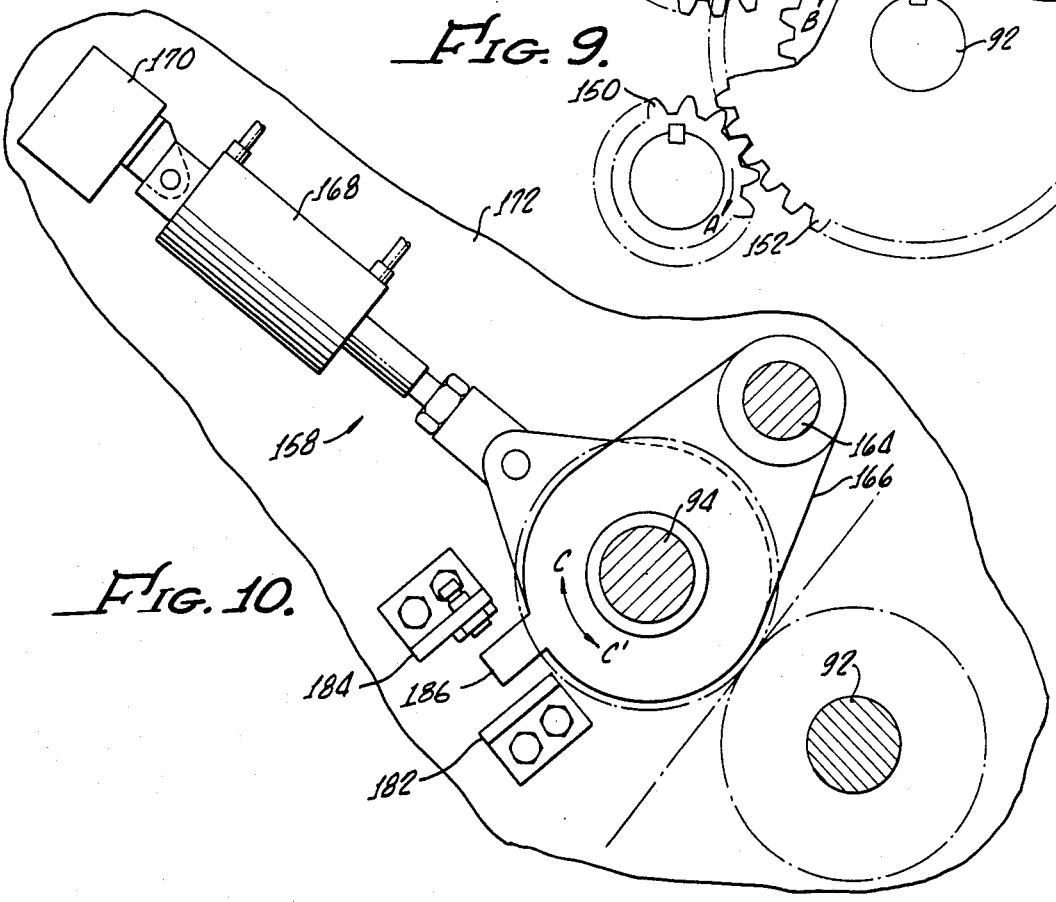
FIG. 10 is a cross-sectional view taken along line 10—10 of FIG. 3 showing relative mounting between the shafts on which the scoring rollers are mounted and a pneumatic cylinder connected for urging one such shaft towards the other.

When use of differently sized nip rollers 160 and 162 and gears 154 and/or 156 is necessary, it may also be necessary to remove one or the other of stops 182 or 184 comprising part of actuating means 158 (FIG. 10) so as to enable sufficient rotational movement of first nip roller shaft 92 in direction C or C'.

Figure 11:
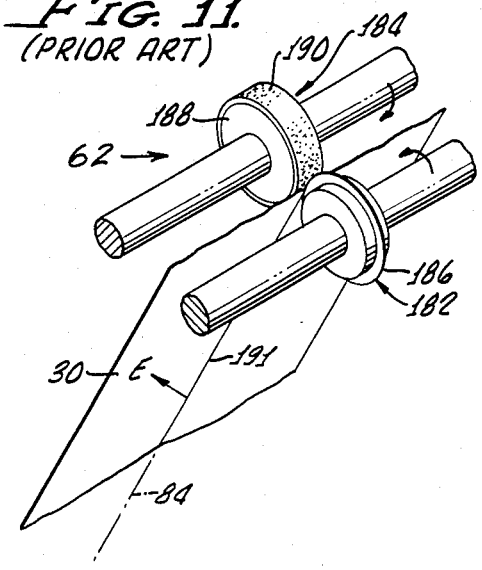
FIG. 11. (PRIOR ART)
FIG. 11 is a pictorial diagram illustrating pre-fold scoring by preexisting scoring rollers.

Operation of scoring rollers 96 and 98 is generally evident from the foregoing description. However, FIGS. 11–15 show comparative operation between scoring apparatus 70 according to the present invention and exemplary, preexisting scoring rollers 182 and 184 comprising preexisting scoring stage 62 (FIG. 11). Preexisting roller 182 is shown comprising a 360° circular scoring blade 186. In contrast, corresponding roller 184 comprises a circular disc 188 having a 360°, peripheral resilient strip 190. Thus, as web 30 advances between rotating rollers 182 and 184, blade 186 makes a continuous, unidirectional score line 191 along web line 84, the peak of the score line being, as shown, always in the same direction of Arrow "E".

Figure 12:
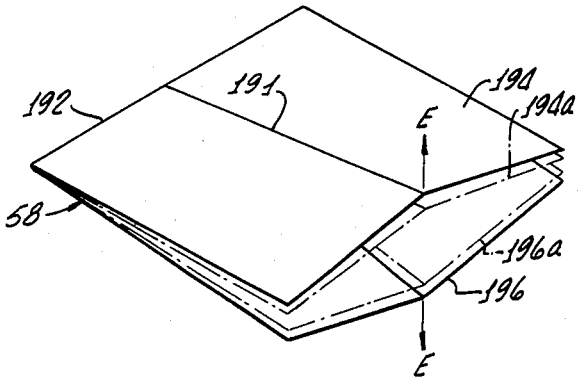
FIG. 12. (PRIOR ART)
FIG. 12 is a pictorial diagram illustrating the condition of paper leaving the first folding stage as scored by preexisting scoring rollers.
Figure 13:
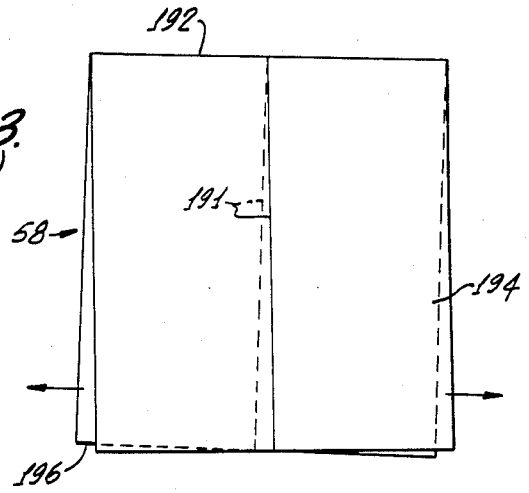
FIG. 13. (PRIOR ART)
FIG. 13 is a pictorial diagram of a typical signature showing misfolding caused by preexisting scoring rollers.

As a result, when web 30 is cut and folded transversely in first folding stage 54, along a fold line 192, (FIG. 12) an upper paper layer 194 of sheet 58 tends to be arched up in its scoring direction "E" while a lower paper layer 196 tends to be arched downwardly in its scoring direction "E". Therefore, as shown in FIG. 13, when the folded sheet of FIG. 12 is fed into second folding stage 56, the two paper layers 194 and 196 tend to be pushed sidewardly relative to one another, causing folding misregistration of the type depicted in FIG. 13. A fine steam of water may be directed along line 84, prior to scoring, by jet 198, shown in phantom lines in FIG. 3, to soften web 30 for scoring.

Figure 14:
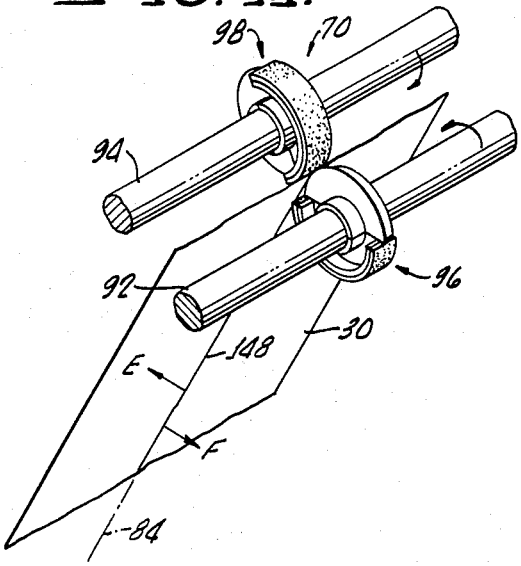
FIG. 14 is a pictorial diagram illustrating the alternating pre-fold scoring by the scoring rollers of the present invention.

In direct contrast, scoring rollers 96 and 98 of the present scoring apparatus 70 cause one half of score line 148 for each sheet 58 to be directed in one direction (direction of Arrow "E") and the other half of the score line to be in the opposite direction (direction of Arrow "F") (FIG. 14). When sheet 58 is then transversely folded along line 192 (FIG. 15) score line 148 of both layers 194 and 196 point in the same direction (Arrows "E" and "F") as the direction in which the layers are folded in second folding stage 56. Because both layers 194 and 196 are nested together, rather than being spaced apart as caused by the above-described conventional scoring, there is virtually no tendency for layers 194 and 196 to slip sidewardly relative to one another and signatures 46 are properly folded even at very high production rates corresponding to maximum or near maximum printing rates of associated press 22.

Figure 15:
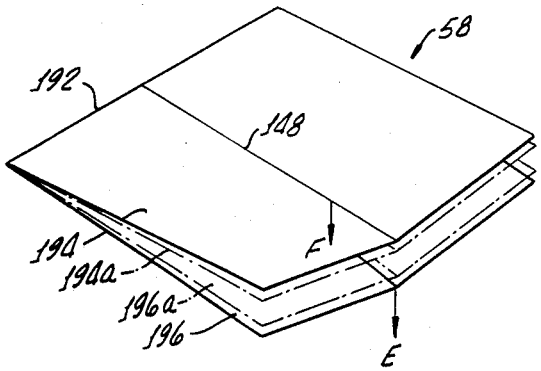
FIG. 15 is a pictorial diagram illustrating the condition of paper leaving the first folding stage as scored by the present scoring rollers.

It can be seen from FIGS. 12 and 15 that the above-described two scoring and folding operations remain unchanged even if web 30 had been prefolded about a longitudinal axis before entering the scoring stage. In such circumstances, a second upper layer 194*a* (shown in phantom lines) would closely parallel upper layer 194 and a second lower layer 196*a* (shown in phantom lines) would closely parallel lower layer 196. Therefore, as previously stated, the effects of any longitudinal prefold of web 30 can be ignored relative to operation of scoring apparatus 70.

It is to be understood that scoring rollers 96 and 98 need not be mounted onto preexisting nip roller shafts 92 and 94 and in some types of signature folding machines, nip roller shafts 92 and 94 may not even be present. It is sufficient that scoring rollers 96 and 98 be mounted on some rotatably driven shafts located intermediate press 22 and first folding stage 54 and the present invention as claimed herein so covers.

It should further be appreciated that blade portion 100 and resilient roller portions 102 need not necessarily each be semicircular. For example, if outer diameter, $D_1$, of rollers 96 and 98 were to be constructed twice the diameter of print rollers in press 22 and the roller mounting shafts were to be rotated at half the rate of the printing rollers, each scoring roller 99 and 98 could be constructed of alternating 90° blade and roller portions. The only requirement is that the arc length of blade and roller portions 100 and 102 be equal in length to the second stage fold.

Some signature folding machines 24 could alternatively be constructed having two series-arranged, "first" folding stages 54 such that two transverse folds would be made before a longitudinal fold is made in a "second" folding stage 56. From the above description and Figures, it is apparent that the sheets would then require that four, instead of two, alternately directed scores be made by apparatus 70, prior to second stage folding. In such case, for the same size scoring rollers 96 and 98, alternating 90° blade and roller portions 100 and 102 would be provided on each roller. Again, the requirement is that the arc length of blade and roller portions 100 and 102 be equal to the length of the "second" stage fold.

A corresponding method for prefolding scoring of web 30 in alternating directions prior to transverse folding is provided. The method comprises forming scoring rollers 96 and 98 in the described configuration, mounting the scoring rollers upstream of "first", transverse folding stage 54 in proper orientation and alignment so as to score web 30 passing therebetween in alternating scoring directions corresponding to the direction in which layers of the transversely folded web is folded in "second" folding stage 56.

Exemplary printing system 20 has, for illustrative purposes, been described above and shown as being of a common, single web type. As a result, although an alternative paper roll 34 is shown in a feeding position, only a single web 30 is advanced by printing system 20 into signature folding machine 24. There, however, exists alternative multi-press printing systems which utilize a plurality, usually two, three or four, printing presses each of which is similar to press 22 shown in FIG. 1 and each of which outputs a separate printed web corresponding to web 30. A common drying oven 44 may be used for all of the webs from each of the printing presses in the multi-press system. The individual webs may be merged (interleaved) in the drying oven or before or as they are fed into a common signature folding machine 24.

In such case, above-described web 30 advancing through signature folding machine 24 is, in fact, a "composite" web formed of a layered plurality of webs, the number of web layers being equal to the number of presses in the multi-press printing system involved. In this regard, it is to be understood that scoring apparatus 70, according to the present invention, provides alternating direction scoring on all the layers of the "composite" web in the manner described above, particularly with respect to the "plow" folded (longitudinally folded) web 30.

Accordingly, although there has been described above a specific arrangement of prefold, web scoring apparatus for use in printing systems and corresponding web scoring methods in accordance with the invention for purposes of illustrating the manner in which the invention may be used to advantage, it is to be appreciated that the invention is not limited thereto. Accordingly, any and all modifications, variations or equivalent arrangements which may occur to those skilled in the art should be considered to be within the scope of the invention as defined in the appended claims.

What is claimed is:

1. In a printing system in which a continuous web of paper is printed and is then fed into a signature folding machine having a first folding stage in which sheets cut from the web are serially folded crosswise to the direction of web travel into the first folding stage and having a second folding stage wherein the folded sheets from the first folding stage are folded at right angles to the first stage fold, prefold scoring apparatus which comprises:

(a) scoring means for prefold scoring of the paper in alternating directions along a longitudinal line corresponding to the second stage fold line, said scoring means including mating first and second scoring members each having separate scoring and resilient abutment portions configured for causing the lengths of the paper scoring in each alternating direction to be equal to the length of the second stage fold and for causing the paper to be scored in directions corresponding to the folding directions of each paper layer in the second folding stage; and (b) means for mounting the scoring means in the path of paper travel intermediate the printing press and the signature folding machine first folding stage so as to enable scoring of the paper before the paper enters the first folding stage.

2. The scoring apparatus as claimed in claim 1 wherein the first and second scoring members comprise respective first and second scoring rollers each having alternating peripheral scoring blade and resilient roller portions, the arc length of each of the blade portions and resilient roller portions being equal to the length of the second stage fold.

3. The scoring apparatus as claimed in claim 2 wherein the mounting means include means for rotatably mounting the first and second scoring rollers so that the paper web passes therebetween, and in such orientation relative to one another that when the scoring rollers are rotated in opposite directions in peripheral rolling contact with one another the scoring blade portion of each said scoring roller abuts the resilient roller portion of the other one of the scoring rollers.

4. The scoring apparatus as claimed in claim 3 wherein the means for rotatably mounting the scoring rollers includes fixing the scoring rollers to preexisting, rotatably driven shafts in the signature folder.

5. The scoring apparatus as claimed in claim 4 wherein the preexisting shafts comprise first and second nip roller shafts, the first scoring roller being fixed to the first nip roller shaft and the second scoring roller being fixed to the second nip roller shaft.

6. In a signature folding machine through which a printed paper is fed for folding into signatures, the folding machine having a first folding stage for folding the paper across the direction of paper travel into the machine and having a second folding stage for folding folded paper from the first stage at right angles to the first stage fold, apparatus for pre-fold scoring of the paper along the second stage fold line, said apparatus comprising:

(a) first and second, complementary-shaped scoring rollers, each of said scoring rollers having alternating, peripheral scoring blade and resilient roller portions, the arc length of each of which is equal to the length of the second stage fold;

(b) means rotatably mounting said first and second scoring rollers in the folding machine upsteam of the first folding stage and in the path of paper travel thereinto, said mounting means mounting the two scoring rollers in mutual, peripheral rolling contact so that the scoring blade portion of each contacts the resilient roller portion of the other as the scoring rollers are rotated, portions of the paper passing between the rotating scoring rollers being thereby scored in one direction and other portions of the paper being scored in the opposite direction in a manner that each layer of paper to be folded in the second folding stage is scored in the correct folding direction; and (c) means for rotating the scoring rollers so that the peripheral velocities thereof are equal to the linear velocity of paper being advanced therebetween.

7. The scoring apparatus as claimed in claim 6 including means for urging the two scoring rollers towards one another to create a sufficient scoring pressure on paper advancing therebetween.

8. The scoring apparatus as claimed in claim 6 wherein the diameter of the blade portion of each of said rollers is between about 0.003" and about 0.008" greater than the diameter of the resilient roller portion thereof.

9. The scoring apparatus as claimed in claim 8 wherein the diameter of blade portion is about 0.005" greater than that of the resilient roller portion.

10. The scoring apparatus as claimed in claim 6 wherein the folding machine includes a pair of first nip rollers mounted in laterally spaced relationship on a first, rotatably driven nip roller shaft and a pair of corresponding second nip rollers mounted in laterally spaced relationship on a corresponding second, rotatably driven nip roller shaft, the first and second nip roller shafts being mounted in the folding machine upstream of the first folding stage and wherein the mounting means include means for non-rotatably mounting the first scoring roller on the first nip roller shaft intermediate the two first nip rollers and for non-rotatably mounting the second scoring roller on the second nip roller shaft intermediate the two second nip rollers.

11. The scoring apparatus as claimed in claims 2 or 6 wherein each of the first and second scoring rollers have an 180° blade portion and an 180° resilient roller portion.

12. The scoring apparatus as claimed in claim 6 wherein the mounting means include a first scoring roller shaft onto which the first scoring roller is mounted and a second scoring roller shaft onto which the second scoring roller is mounted.

13. The scoring apparatus as claimed in claim 12 wherein the rotating means cause the first and second scoring roller shafts to rotate in opposite, paper advancing directions and at a rotational rate equal to the rotational rate of printing cylinders of an associated web printing press from which paper is fed into the folding machine.

14. The scoring apparatus as claimed in claim 12 wherein each of the scoring rollers is formed having a central shaft mounting aperture having a diameter which is an interference fit relative to the outside diameter of the first and second scoring roller shafts, wherein the scoring rollers are split in half across a diameter and wherein the mounting means include means for clamping the two halves of each said scoring roller together around its respective mounting shaft.

15. The scoring apparatus as claimed in claims 2 or 6 wherein the mounting means include means enabling rotational and lateral positional adjustment of the scoring rollers to enable alignment of the scoring blade portions with the second stage folding line.

16. In a signature folding machine connected for receiving a web of printed paper from an associated web-type printing press, the folding machine having a first folding stage in which the printed web is folded across the direction of web travel thereinto and is cut into sheets, and a second folding stage in which the folded sheets from the first folding stage are folded at right angles to the fold made in the first folding stage so that the fold made in the second folding stage is on a longitudinal line of the printed web entering the first folding stage, pre-fold scoring apparatus for scoring the printed web along the second stage fold line before the sheet enters the second folding stage, said prefold scoring apparatus comprising:

(a) mating first and second scoring rollers, each of said scoring rollers having a scoring blade portion and a resilient roller portion forming the outer periphery thereof, each of the scoring blade and resilient roller portions having an arc length equal to the length of the second stage paper fold;

(b) means for mounting the first and second scoring rollers in peripheral rolling contact with each other upstream relative to web travel direction into the first folding stage and so that the web entering the first folding stage passes between the two scoring rollers, said mounting means including a first scoring roller shaft onto which the first scoring roller is non-rotatably mounted and a second scoring roller shaft onto which the second scoring roller is non-rotatably mounted, said scoring rollers being oriented on their respective mounting shafts so that when the mounting shafts are rotated in opposite rotational directions, the scoring blade portion of each scoring roller contacts the resilient roller portion of the other scoring roller, and so that the paper passing between the scoring rollers is scored along the second stage fold line in alternating scoring directions in a manner causing each layer of a sheet of paper subsequently being folded in the second folding stage to be scored in its correct folding direction;

(c) means for urging the two scoring roller shafts together so as to cause the scoring blade portions of each of the scoring rollers to indent the corresponding resilient roller portion of the other scoring roller to a preestablished depth; and (d) means for rotating the scoring roller shafts at the same rotational speed but in opposite rotational directions, said rotational speed providing a peripheral scoring roller velocity equal to the feeding velocity of the paper being scored by the scoring rollers.

17. The scoring apparatus as claimed in claim 16 wherein the first and second scoring roller shafts comprise preexisting first and second nip roller shafts mounted in the signature folding machine, said first nip roller shaft also having mounted thereon two laterally spaced apart first nip rollers and said second nip roller shaft also having mounted thereon two laterally spaced apart second nip rollers, the first scoring roller being mounted on the first nip roller shaft between the two first nip rollers and the second scoring roller being mounted on the second nip roller shaft between the two second nip rollers.

18. The scoring apparatus as claimed in claim 17 wherein the outer diameter of the first and second nip rollers is equal to the outer diameter of the resilient roller portion of the first and second scoring rollers.

19. The scoring apparatus as claimed in claims 2, 6, or 16 wherein the scoring blade portions of the first and second scoring rollers each comprise a scoring blade having an arcuate scoring edge and means for detachably fixing said blade to the associated scoring roller so as to enable replacement of the scoring blades without dismounting the scoring rollers.

20. The scoring apparatus according to claim 19 wherein the arcuate edge of the scoring blades has a width of between about 0.020" and about 0.050" at the point of paper contact.

21. The scoring apparatus according to claim 16 wherein the scoring roller mounting means are configured for enabling the scoring rollers to be installed onto and removed from their respective mounting shafts without removal of the shafts from the signature folding machine, the scoring rollers being thereby split in half along a diameter and having a shaft mounting aperture having a diameter which causes an interference fit when the scoring roller halves are clamped together, by included clamping means, around the mounting shafts.

22. The scoring apparatus as claimed in claims 2, 6 or 16 wherein the first and second scoring rollers are substantially identical to one another, wherein the scoring blade portion of each comprises a blade having an arcuate scoring edge and means for mounting said blade to the associated scoring roller at mid width thereof so as to be substantially centered with respect to the resilient roller portion of the same scoring roller.

23. In a signature folding machine connected for receiving a continuous web of printed paper from an associated web-type printing press, the folding machine having a first paper folding stage in which the printed web is cut into sheets and the sheets are folded across the direction of travel of the web into the first folding stage, having a second paper folding stage in which the folded sheets from the first folding stage are folded at right angles to the fold made in the first folding stage, the second stage fold being thereby along a longitudinal web line and having pairs of first and of second nip rollers mounted on respective, rotary-driven first and second nip roller shafts upstream of the first folding stage, the web being advanced between pairs of first and second nip rollers mounted on the nip roller shafts into the first folding stage, apparatus for pre-fold scoring of the web along the line of the fold made in the second folding stage, said apparatus comprising:

(a) first and second scoring rollers each having a 180° peripheral scoring blade and a 180° peripheral resilient roller, the outer diameter of the resilient roller of the first and second scoring rollers being the same as the outer diameter of printing cylinders in the web-type printing press associated with the folding machine, and the outer diameter of the scoring blade of the first and second scoring rollers being a preselected amount greater than the outer diameter of the resilient roller and the scoring blades being positioned mid-width of the associated resilient roller; and (b) means for non-rotatably mounting the first scoring roller on the first nip roller shaft intermediate the pair of first nip rollers and for non-rotatably mounting the second scoring roller on the second nip roller shaft intermediate the pair of second nip rollers, with the scoring blades of the scoring rollers aligned along the intended fold line of the second folding stage and the scoring rollers rotationally oriented relative to one another so that when the scoring rollers are rotated by the nip roller shafts, the scoring blade on each scoring roller rolls along the resilient roller of the other scoring roller and is rotationally oriented relative to the web passing therebetween and the second folding stage so that each paper layer being folded in the second folding stage is scored by one of the scoring blades in the correct folding direction.

24. The scoring apparatus as claimed in claim 23 wherein the outer diameter of the scoring blade is about 0.005" greater than the diameter of the resilient roller and wherein thickness of the scoring blade at the outer periphery thereof is between about 0.020" and about 0.050".

25. The scoring apparatus as claimed in claim 23 wherein each of the first and second scoring rollers is split in half along a diameter, the scoring blade being detachably fixed to one half and the resilient roller to the other half and wherein the scoring roller mounting means include means for clamping the two halves of each of the scoring rollers around the nip roller shaft to which the scoring roller is mounted, the scoring rollers being formed having a shaft mounting aperture which provides an interference fit relative to shaft diameter.

26. Paper scoring apparatus for modifying a preexisting signature folding machine configured for receiving a printed web of paper from a web-type printing press, the folding machine having a first folding stage in which the printed web is cut into sheets and the sheets are serially folded across the direction of web travel into the first folding stage, having a second folding stage into which the folded sheets from the first folding stage are serially fed for folding at right angles to the first stage fold, and having, just upstream of the first folding stage, rotatably driven, preexisting first and second shafts onto which are fixed respective pairs of first and second preexisting nip rollers for controlling flow of the web passing therebetween and into the first folding stage, said first and second shafts having preexisting intermeshing first and second gears fixed thereon to enable one of said shafts to be rotatably driven from a drive gear and to rotatably drive the other one of said shafts, said scoring apparatus comprising:

(a) first and second scoring rollers, each of said scoring rollers having alternating peripheral scoring blade portions and resilient roller portions, each of said portions having an arc length equal to the length of the second stage fold; and (b) means for non-rotatably mounting the first and second scoring roller to respective ones of said preexisting first and second shafts without the necessity for removing said preexisting shafts from the folding machine, said mounting means enabling lateral and rotatable position adjustment of the scoring rollers on said preexisting shafts.

27. The scoring apparatus as claimed in claim 26 including:

(a) pairs of first and second replacement nip rollers, the outer diameters of said first and second replacement nip rollers being equal to the outer diameter of the resilient roller portions of the respective first and second scoring rollers;

(b) means for non-rotatably mounting the pairs of first and second replacement nip rollers to respective ones of the preexisting first and second shafts in place of the corresponding preexisting first and second nip rollers mounted thereon; and (c) at least one replacement gear for mounting on the preexisting first or second shaft in replacement of the preexisting first or second gear mounted thereon, said replacement gear having an outer diameter enabling the first and second shafts to be positioned together with the first and second ones of the scoring rollers and the replacement nip rollers in rolling contact with other corresponding ones thereof.

28. A paper prescoring method for improving the operation of a signature folding machine to which a printed web is fed from an associated web-type printing press, the signature folding machine having a first folding stage in which the web is cut into a series of sheets which are folded across the direction of web travel and having a second folding stage into which the folded sheets from the first folding stage are folded at right angles to the first stage fold, the method comprising the steps of:

(a) forming first and second scoring rollers each having alternating scoring blade portions and resilient roller portions which are each equal in arc length to the length of paper fold made in the second folding stage, and (b) mounting the first and second scoring rollers in the path of web travel into the first folding stage so as to cause the scoring of the web passing between the scoring rollers in alternating scoring directions corresponding to the paper layer folding directions in the second folding stage.

29. The scoring method as claimed in claim 28 wherein the step of mounting the prescoring rollers includes mounting the first and second scoring rollers on respective, preexisting first and second nip roller shafts, the first scoring roller being mounted beween a pair of preexisting first nip rollers and the second scoring roller being mounted between a pair of preexisting second nip rollers.

30. The scoring method as claimed in claim 28 wherein the preexisting first and second nip rollers are different in outer diameter from the respective first and second scoring rollers and including the step of modifying the outer diameter of the first and second nip rollers to that of the resilient roller portions of the respective first and second scoring rollers.

31. The scoring method as claimed in claim 30 wherein a gear fixed to one of the first and second nip roller shafts drivingly engages a gear fixed to the other of said shafts, including the step of modifying the size of at least one of said gears to correspond to the changed size of the first and second nip rollers.

* * * * *